US010277986B2

(12) United States Patent
Li

(10) Patent No.: US 10,277,986 B2
(45) Date of Patent: Apr. 30, 2019

(54) MINIATURE SPEAKER INCLUDES A FLEXIBLE CIRCUIT BOARD LOCATED BELOW A DIAPHRAGM

(71) Applicant: AAC Technologies Pte. Ltd., Singapore (SG)

(72) Inventor: Wei Li, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/677,060

(22) Filed: Aug. 15, 2017

(65) Prior Publication Data

US 2018/0302724 A1 Oct. 18, 2018

(30) Foreign Application Priority Data

Apr. 13, 2017 (CN) ..... 2017 2 0382996 U

(51) Int. Cl.

| | |
|---|---|
| ***H04R 9/06*** | (2006.01) |
| ***H04R 1/02*** | (2006.01) |
| ***H04R 7/12*** | (2006.01) |
| ***H04R 9/02*** | (2006.01) |
| ***H04R 1/06*** | (2006.01) |
| ***H04R 7/18*** | (2006.01) |

(52) U.S. Cl.

CPC ..... *H04R 9/06* (2013.01); *H04R 1/023* (2013.01); *H04R 1/06* (2013.01); *H04R 7/12* (2013.01); *H04R 7/18* (2013.01); *H04R 9/025* (2013.01); *H04R 2400/11* (2013.01)

(58) Field of Classification Search

CPC . H04R 9/06; H04R 9/025; H04R 1/06; H04R 1/023; H04R 7/12

See application file for complete search history.

(56) References Cited

U.S. PATENT DOCUMENTS

| | | | | |
|---|---|---|---|---|
| 8,275,158 | B2 * | 9/2012 | Kim | H04R 17/00 381/190 |
| 9,185,494 | B2 * | 11/2015 | Choi | H04R 9/043 |
| 9,338,535 | B2 * | 5/2016 | Shao | H04R 9/10 |
| 2011/0075880 | A1 * | 3/2011 | Kamimura | H04R 1/06 381/413 |

(Continued)

*Primary Examiner* — Md S Elahee
*Assistant Examiner* — Angelica M McKinney
(74) *Attorney, Agent, or Firm* — Na Xu; IPro, PLLC

(57) ABSTRACT

The present disclosure provides a miniature speaker, including a frame, and a vibrating unit and a magnetic unit which are fixedly connected with the frame; the vibrating unit includes a voice diaphragm, a voice coil located below the voice diaphragm and configured to drive the voice diaphragm to vibrate, and an elastic supporting member located below the voice coil and configured to elastically support the voice coil; the elastic supporting member includes a diaphragm and a flexible circuit board fixedly connected below the diaphragm; the diaphragm includes a first connecting portion fixedly connected with the frame, a second connecting portion fixedly connected with the voice diaphragm and a suspension connecting the first connecting portion with the second connecting portion; the suspension is an upward protruded structure protruding toward the voice diaphragm, and the voice coil transmits an electric signal to an external circuit through the flexible circuit board.

5 Claims, 4 Drawing Sheets

(56) References Cited

U.S. PATENT DOCUMENTS

| | | | | |
|---|---|---|---|---|
| 2013/0156237 | A1* | 6/2013 | Kim | H04R 9/06 381/191 |
| 2014/0056447 | A1* | 2/2014 | Li | H04R 1/00 381/162 |
| 2014/0056465 | A1* | 2/2014 | Li | H04R 9/025 381/400 |
| 2014/0376766 | A1* | 12/2014 | Chen | H04R 9/02 381/400 |
| 2015/0189442 | A1* | 7/2015 | Zhang | H04R 9/025 381/409 |
| 2016/0037243 | A1* | 2/2016 | Lippert | H04R 1/023 381/166 |
| 2016/0173990 | A1* | 6/2016 | Park | H04R 1/06 381/354 |

* cited by examiner

MINIATURE SPEAKER INCLUDES A FLEXIBLE CIRCUIT BOARD LOCATED BELOW A DIAPHRAGM

TECHNICAL FIELD

The present disclosure relates to the field of electroacoustic conversion techniques and, particularly, relates to a miniature speaker.

BACKGROUND

In recent years, with the development of techniques, especially the rapid development of mobile communication techniques, more and more mobile electronic devices appear in people's life. For example, smart phones, tablet PC, laptops and multi-functional media player have become necessities in people's daily life. In these mobile electronic devices, a voice player is an essential component, and voice quality of the voice player can directly influence experience of a user when using these mobile electronic devices.

A miniature speaker is used as the voice player, and a structure of the miniature speaker directly influences the voice quality. In the relevant art, the miniature speaker includes a frame, a voice diaphragm, a voice coil, a diaphragm and a flexible circuit board. The voice coil is located below the voice diaphragm and is configured to drive the voice diaphragm to vibrate and sound. The diaphragm is configured to elastically support the voice coil. The flexible circuit board is located below the voice coil and is fixedly connected with the voice coil, so as to connect the voice coil with an external circuit. The diaphragm is fixed connected below the flexible circuit board. The diaphragm includes a first connecting portion, a second connecting portion and a suspension. The first connecting portion is fixedly connected with the frame, the second connecting portion is fixed connected with the voice diaphragm, and the suspension connects the first connecting portion with the second connecting portion. Additionally, the miniature speaker further includes a lower clamping plate located at a lower end of the frame, the suspension is a downward recessed structure recessed toward the lower clamping plate, and an airflow channel is defined between the diaphragm and the lower clamping plate. The voice coil vibrates to generate air flow, and the air flow flows out through a leaking hole in the frame. When the suspension is the downward recessed structure recessed toward the lower clamping plate, the suspension will occupy space of the airflow channel. As a result, the air flow cannot be smoothly discharged and thus the air inside the miniature speaker cannot flow smoothly, and the heat radiation of the miniature speaker is reduced accordingly. Additionally, when the miniature speaker is made into a speaker box, a sound absorbing material will be filled in a rear cavity of the speaker box. Since the air in the speaker cannot flow smoothly, the sound absorbing material cannot effectively improve a low frequency performance of the speaker.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

In order to further clarify objectives, technical solutions and advantages of the present disclosure, exemplary embodiments of the present disclosure are illustrated in detail with reference to the drawings. It should be noted by those skilled in the art that, the technical details provided in the exemplary embodiments are merely used to help a reader better understand the present disclosure. However, based on various changes and modifications to the following exemplary embodiments, the technical solutions protected by the claims can still be implemented even without these details.

Figure 1:
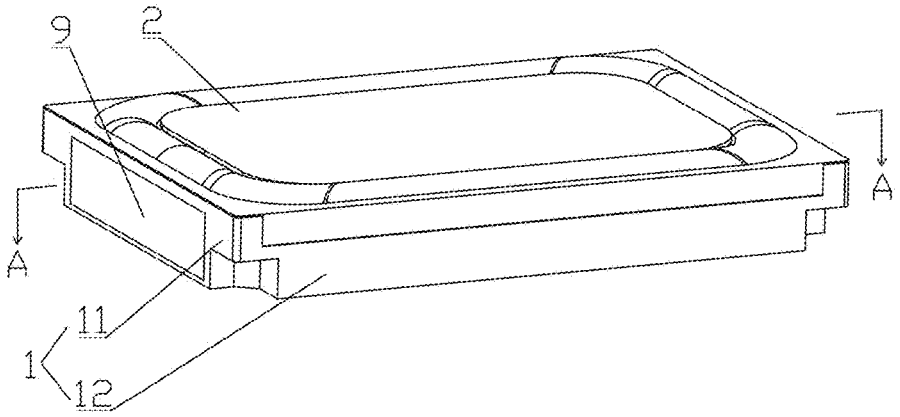
FIG. 1 is a structural schematic diagram of a miniature speaker in accordance with an exemplary embodiment of the present disclosure.
Figure 2:
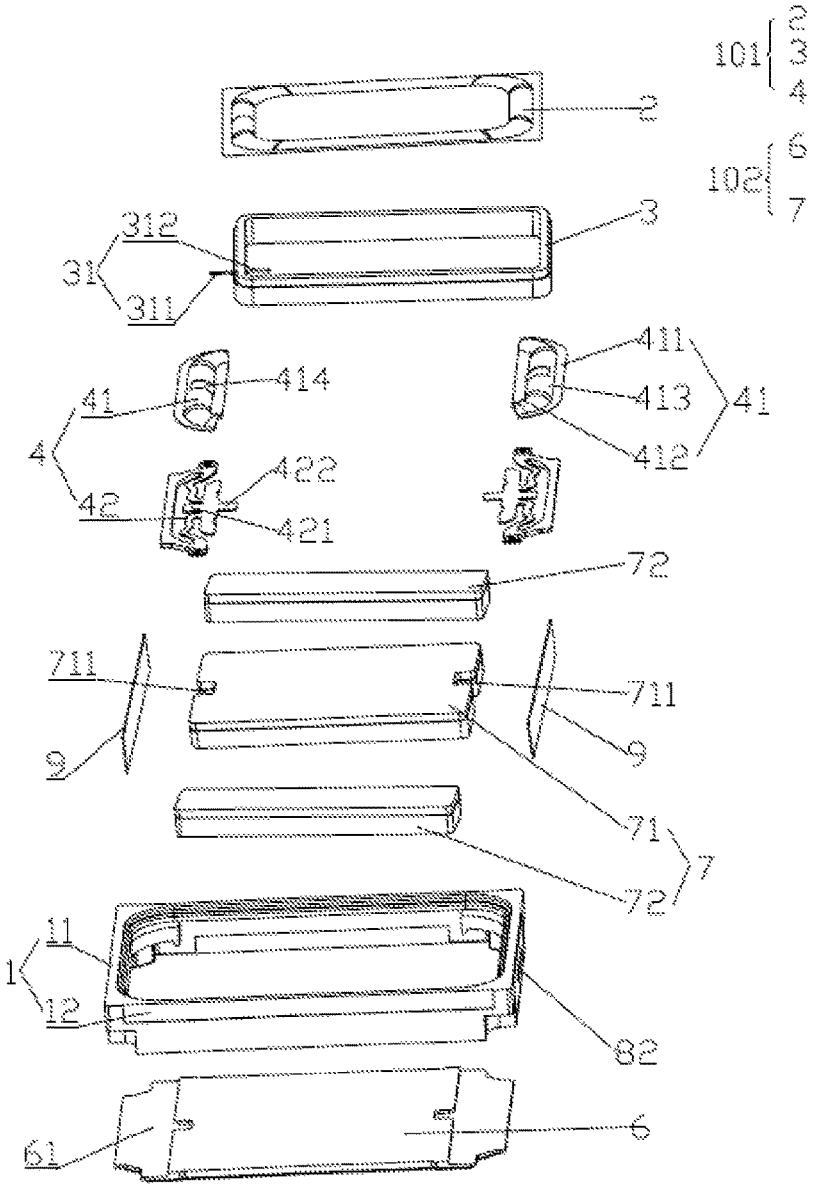
FIG. 2 is an exploded view of a miniature speaker in accordance with an exemplary embodiment of the present disclosure.
Figure 3:
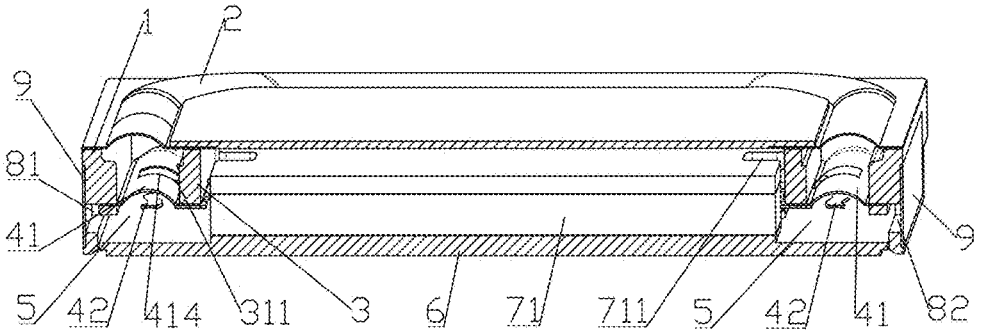
FIG. 3 is a sectional view along A-A direction in FIG. 1.
Figure 4:
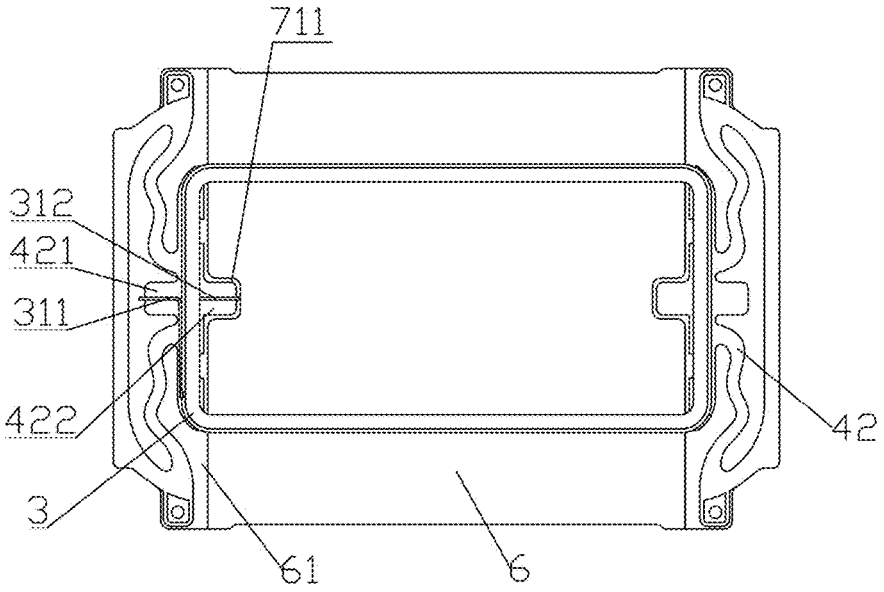
FIG. 4 is a structural schematic diagram of a voice coil, a flexible circuit board and a lower clamping plate assembled in a miniature speaker in accordance with an exemplary embodiment of the present disclosure.

The present disclosure provides a miniature speaker. As shown in FIGS. 1-4, the miniature speaker includes a frame 1, a vibration unit 101 and a magnetic unit 102 fixedly connected with the frame 1. In an exemplary embodiment, the frame 1 includes a pair of short side walls 11 and a pair of long side walls 12. The vibration unit 101 mainly includes a voice diaphragm 2, a voice coil 3 located below the voice diaphragm 2, and an elastic supporting member 4 located below the voice coil 3. The elastic supporting member 4 is arranged at the pair of short side walls 11 of the frame 1.

The voice coil 3 is configured to drive the voice diaphragm 2 to vibrate and sound, and the elastic supporting member 4 is configured to support the voice coil 3. The elastic supporting member 4 includes a diaphragm 41 and a flexible circuit board 42, and the flexible circuit board 42 is located below the diaphragm 41 and is fixedly connected with the diaphragm 41. An external circuit transmits an electric signal to the voice coil 3 through the flexible circuit board 42. The diaphragm 41 mainly includes a first connecting portion 411, a second connecting portion 412 and a suspension 413. The first connecting portion 411 is fixedly connected with the frame 1, the second connecting portion 412 is fixedly connected with the voice diaphragm 2 voice coil 3, and the suspension 413 connects the first connecting portion 411 with the second connecting portion 412. The suspension 413 is an upward protruded structure protruding toward the voice diaphragm 2. In the present embodiment, the suspension 413 is structured in an upward protruded arc.

In an exemplary embodiment, the elastic supporting member 4 includes two diaphragms 41 and two flexible circuit boards 42. The two diaphragms 41 are provided below the voice coil 3 and are symmetrically arranged with respect to the voice coil 3. The two flexible circuit boards 42 are symmetrically arranged below the two diaphragms 41, respectively.

The flexible circuit board 42 includes a first welding pad 421 and a second welding pad 422, the first welding pad 421 is located at an external side of the voice coil 3, the second welding pad 422 is located at an internal side of the voice coil 3, and the first welding pad 421 extends to an underneath of the suspension 413. The voice coil 3 includes a lead 31 of voice coil 3, and the lead 31 of voice coil 3 includes a first lead 311 and a second lead 312. The first lead 311 extends out of the voice coil 3 from an external side of the voice coil 3, and the second lead 312 extends out of the voice coil 3 from an internal side of the voice coil 3. The voice coil 3 is separated from the flexible circuit board 42 by the diaphragm 41, so that the voice coil 3 cannot directly contact with the flexible circuit board 42. In order to realize electrical connection between the voice coil 3 and the flexible circuit board 42, the diaphragm 41 further includes a through hole 414 in the suspension 413. The first lead 311 passes through the through hole 414 to be electrically connected with the first welding pad 421, and the second lead 312 is electrically connected with the second welding pad 422.

The magnetic unit 102 includes a magnet 7 and a lower clamping plate 6 configured to hold the magnet 7. The lower clamping plate 6 is located at a lower end of the frame 1, and the lower clamping plate 6 includes a recessed portion 61 located below the elastic supporting member 4. The diaphragm 41 and the lower clamping plate 6 define an airflow channel 5 configured for passing of air flow. In an exemplary embodiment, the magnet 7 includes a main magnet 71 and an auxiliary magnet 72 located at two sides of the main magnet 71, and the auxiliary magnet 72 is further arranged at the pair of long side walls 12 of the frame 1. The main magnet 71 further includes an avoiding portion 711, and the avoiding portion 711 is arranged at a position of the main magnet 71 which is at an internal side of the voice coil 3 and adjacent to a pair of flexible circuit boards 42. The avoiding portion 711 is a groove which is located on the main magnet 71 and is configured to accommodate the second welding pad 422. In order to guarantee that air in the speaker can flow smoothly, the miniature speaker further includes a venting hole 8, and the venting hole 8 penetrates through the frame 1 and communicates between internal and external space of the speaker. In the present embodiment, the miniature speaker includes two venting holes 81, 82, and the two venting holes 81, 82 are located in the pair of short side walls 11 of the frame 1, respectively. In order to prevent a sound absorbing material filled in a rear cavity of a speaker box (not shown in the figures) from entering into the interior of the miniature speaker, the two venting holes 81, 82 are covered by a mesh 9.

Since the suspension 413 of the diaphragm 41 is an upward protruded structure protruding toward the voice diaphragm 2, the suspension 413 does not occupy any space of the airflow channel 5 of the speaker. The flexible circuit board 42 is provided below the diaphragm 41 and is fixedly connected with the diaphragm 41, thus, the air flow in the speaker can flow out of the speaker through the airflow channel 5, so that heat dissipation effect of the speaker is improved. When the miniature speaker is installed into a speaker box, a sound absorbing material will be filled in a rear cavity of the speaker box (not shown in the figures). Since the air in the speaker can flow smoothly out of the speaker, the sound absorbing material can effectively improve low frequency sounding performance of the speaker. Moreover, the upward protruded structure of the suspension 413 further improves utilization rate of the internal space of the speaker.

The above are merely exemplary embodiments of the present disclosure. It should be noted that, those skilled in the art can make improvements to the present disclosure without departing from the disclosure concept of the present disclosure, and all these improvements shall fall into the protection scope of the present disclosure.

What is claimed is:

1. A miniature speaker, comprising:

a frame;

a vibrating unit fixedly connected with the frame, comprising a voice diaphragm, a voice coil and an elastic supporting member; and a magnetic unit fixedly connected with the frame;

wherein the voice coil is located below the voice diaphragm and is configured to drive the voice diaphragm to vibrate and sound; the elastic supporting member is located below the voice coil and is configured to elastically support the voice coil;

the elastic supporting member comprises a diaphragm and a flexible circuit board; and the flexible circuit board is located below the diaphragm and is fixedly connected with the diaphragm, an external circuit transmits an electric signal to the voice coil through the flexible circuit board;

the diaphragm comprises a first connecting portion, a second connecting portion and a suspension, the first connecting portion is fixedly connected with the frame, the second connecting portion is fixedly connected with the voice coil, and the suspension connects the first connecting portion with the second connecting portion; the suspension is an upward protruded structure protruding toward the voice diaphragm.

2. The miniature speaker as described in claim 1, wherein the diaphragm further comprises a through hole penetrating through the suspension, the voice coil comprises a lead, and the lead passes through the through hole and is electrically connected with the flexible circuit board.

3. The miniature speaker as described in claim 2, wherein the flexible circuit board comprises a first welding pad and a second welding pad, the first welding pad is located at an external side of the voice coil, the second welding pad is located at an internal side of the voice coil, and the first welding pad extends to an underneath of the suspension;

the lead comprises a first lead and a second lead, the first lead extends out of the voice coil from the external side of the voice coil, and the second lead extends out of the voice coil from the internal side of the voice coil; the first lead passes through the through hole and is electrically connected with the first welding pad, and the second lead is electrically connected with the second welding pad; the magnetic unit comprises an avoiding portion configured to provide space for the second welding pad.

4. The miniature speaker as described in claim 1, further comprising:

a venting hole penetrating through the frame and communicating between internal space and external space of the miniature speaker; and a mesh fixedly connected with the frame and completely covering the venting hole;

wherein the magnetic unit comprises a magnet and a lower clamping plate, and the lower clamping plate is clamped at a lower end of the frame so as to hold the magnet;

the diaphragm and the lower clamping plate together define an airflow channel, the airflow channel is between the diaphragm and the lower clamping plate, and the airflow channel is communicated with the venting hole.

5. The miniature speaker as described in claim 4, wherein the lower clamping plate comprises a recessed portion located below the elastic supporting member.

* * * * *